US005428185A

United States Patent [19]

Kunimoto et al.

[11] Patent Number: 5,428,185

[45] Date of Patent: Jun. 27, 1995

[54] MUSICAL TONE SYNTHESIZING APPARATUS

[75] Inventors: Toshifumi Kunimoto; Mitsuru Fukui, both of Hamamatsu, Japan

[73] Assignee: Yamaha Corporation, Japan

[21] Appl. No.: 111,024

[22] Filed: Aug. 24, 1993

Related U.S. Application Data

[63] Continuation of Ser. No. 626,843, Dec. 13, 1990, abandoned.

[30] Foreign Application Priority Data

Dec. 15, 1989 [JP] Japan ..... 1-325249

[51] Int. Cl.[6] ..... G10H 1/057; G10H 1/12; G10H 1/18

[52] U.S. Cl. ..... 84/658; 84/661; 84/663; 84/DIG. 9; 84/DIG. 10

[58] Field of Search ..... 84/615–620, 84/622–633, 658–665, 687–690, 692–711, 735–742, DIG. 9, DIG. 10

[56] References Cited

U.S. PATENT DOCUMENTS

| | | | |
|---|---|---|---|
| Re. 31,004 | 8/1982 | Niimi . | |
| 3,347,973 | 10/1967 | Freeman | 84/708 |
| 4,655,115 | 4/1987 | Nishimoto | 84/DIG. 10 |
| 4,658,690 | 4/1987 | Aitken et al. | 84/629 |
| 4,815,354 | 3/1989 | Kunimoto | 84/DIG. 10 |
| 4,984,276 | 1/1991 | Smith . | |
| 5,010,801 | 4/1991 | Sakashita | 84/735 |
| 5,025,703 | 6/1991 | Iba et al. | 84/701 X |

FOREIGN PATENT DOCUMENTS

| | | |
|---|---|---|
| 58-48109 | 10/1983 | Japan . |
| 58-58679 | 12/1983 | Japan . |
| 63-40199 | 2/1988 | Japan . |

*Primary Examiner*—Stanley J. Witkowski
*Attorney, Agent, or Firm*—Graham & James

[57] ABSTRACT

A musical tone synthesizing apparatus synthesizes musical tones by simulating the tone generation construction of an acoustic musical instrument. The acoustic musical instrument comprises of a tone generating element and a tone generating operator for exciting the tone generating element, thereby creating reciprocally propagating vibration within the tone generating element. The musical tone synthesizing apparatus has a parameter producing portion which automatically produces a plurality of control parameters used for controlling a simulation of the acoustic musical instrument in response to operational information representing the operation applied to the acoustic musical instrument by a performer, musical tone synthesizing portion which synthesizes a musical tone of the acoustic musical instrument, wherein the operation of the musical tone synthesizing portion is controlled in accordance with the control parameters. The parameter producing portion includes, for example, keyboard apparatus having a keyboard. By adjusting the touch of key in keyboard, it is possible to variously control the musical tone by easy operation. Accordingly, the control parameters to be need for synthesizing a musical tone are easily inputted to the musical tone generating portion. In addition, the musical tone generating portion can generate a musical tone with easy operation regardless of the ease where complicated controlling the control parameters is needed.

16 Claims, 6 Drawing Sheets

MUSICAL TONE SYNTHESIZING APPARATUS

This application is a continuation of application Ser. No. 07/626,843, filed Dec. 13, 1990, now abandoned.

BACKGROUND OF THE INVENTION

FIELD OF THE INVENTION

The present invention relates to a musical tone synthesizing apparatus which synthesizes musical tones of an acoustic musical instrument with fidelity.

PRIOR ART

Devices are well known wherein, by activating the simulation model of the tone generation mechanism of the acoustic musical instrument, sounds of the acoustic musical instrument can be artificially synthesized.

As an example, there is the known device which synthesizes the sounds of the stringed instrument by the configuration containing a low-pass filter for simulating reverberation losses in the strings and a delay circuit for simulating propagation delays of the vibration of the strings, wherein the low-pass filter and delay circuit are connected together so as to form a closed-loop circuit. With such a degree, an excitation signal (e.g., an impulse signal) is introduced into the closed-loop circuit. Thus, the introduced impulse signal circulates through the closed-loop circuit once with a period identical to the period in which the vibration reciprocates through the string once. The signal circulating through the closed-loop circuit is subject to the bandwidth restriction each time it traverses the low-pass filter. Then, the circulating signal is picked up from the closed-loop circuit as a musical tone signal.

With the device described above, by adjusting the delay time of the delay circuit and the characteristics of the low-pass filter, sounds of the plucked stringed instrument such as a guitar, or those of the percussive stringed instrument such as a piano can be synthesized, having characteristics very close to those of the acoustic musical instrument. The musical tone synthesizing apparatus which synthesizes the sounds of the violin can be embodied by connecting an excitation circuit to the above-mentioned closed-loop circuit, wherein this excitation circuit is designed to generate the signal corresponding to the excitation vibration to be imparted to the string by the bow. The signal corresponding to the vibrating velocity of the string is taken out from the closed-loop circuit and then inputted to the exaltation circuit, wherein a non-linear operation is performed on the inputted signal by use of parameters concerning the bowling velocity and bowing pressure. The result of the non-linear operation is fed back to the closed-loop circuit as the excitation signal. In this way, the circulation of signal is excited in the closed-loop circuit, and the signal circulating through the closed-loop circuit is outputted as the musical tone signal. Incidentally, this type of the musical tone synthesizing apparatus Is disclosed in Japanese Patent Laid-Open Publication No. 63-40199 and Japanese Patent Publication No. 58-58679.

With the conventional musical tone synthesizing apparatus described above, it is necessary to input the control parameter, for example, parameter used for non-linear operation when the musical tone is generated. For this reason, such an apparatus is disadvantageous in that the manual operation for inputting the above control parameters into the excitation circuit is troublesome.

In addition, some musical tones to be synthesized requires the large number of the control parameters. Furthermore, it is necessary to control the control parameter in a lapse of time, such that each control parameter satisfies the specific characteristic of the musical instrument to be simulated. In such case, it is extremely difficult to perform the operation for inputting the control parameters used for generating the sounds into the excitation circuit.

For example, in the case where the control parameters corresponding to the bowing velocity and bow pressure are controlled properly, the musical tone synthesizing apparatus simulating the sounds of the violin described above can generate successfully the musical tone. On the contrary, in the case where the control parameters are not given properly, the above apparatus cannot generate successfully the musical tone.

FIG. 16 is a graph showing a two-dimensional map, wherein the lateral axis corresponds to bowling velocity parameter V and the longitudinal axis corresponds to bowing pressure parameter F. Herein, the whole graphic area of FIG. 16 is divided into three areas X, Y, Z, each regulating the relationship between V, F. More specifically, if the relationship between V, F enters into the area X, the musical tone is generated. Similarly, Y represents an area in which generation of the musical tone is maintained, while Z represents an area in which generation of the musical tone is not maintained. To generate sounds of the violin and maintain it, bowing velocity parameter V and bowing pressure parameter F must be controlled, such that the state of the musical tone is varied within above areas X and Y. In addition, to generate sounds of the violin which are not hard to listen to, both of the parameters V and F must be controlled, such that the state of the musical tone Is varied within the further limited area in the two-dimensional map shown in FIG. 16. This make It extremely difficult to adjust the bowling velocity and bowing pressure in the actual performance of violin. Furthermore, the disadvantage described before is not only occurred in the musical tone synthesizing apparatus synthesizing the sounds of the violin, but it is also occurred in the musical tone synthesizing apparatus for synthesizing the musical tones of other acoustic musical instruments. Therefore, the conventional musical tone synthesizing apparatus is disadvantageous in that it Is difficult to control various kinds of the control parameters for generating and maintaining the musical tone.

SUMMARY OF THE INVENTION

In consideration of the above described shortcomings of conventional apparatus for synthesizing the sound of acoustic musical instruments, a primary object of the present invention is to provide a musical tone synthesizing apparatus in which the control parameters to be need for synthesizing a musical tone are easily inputted.

A further object of the present invention Is to provide a musical tone synthesizing apparatus which can generate a musical tone with easy operation regardless of the case where complicated controlling the control parameters is needed.

In one implementation of the present invention, a musical tone synthesizing apparatus comprising:

(a) parameter producing means for automatically producing a plurality of control parameters in response to operational information representing an operation applied to an acoustic musical instrument by a performer; and (b) musical tone synthesizing means for synthesizing a musical tone, wherein an operation of said musical tone synthesizing means is controlled in accordance with said control parameters.

The preferred embodiments of the present invention are described in a following section with reference to the drawings, from which further objects and advantages of the present invention will become apparent.

DETAILED DESCRIPTION OF THE PREFERRED EMBODIMENTS

[A]CONFIGURATION OF FIRST EMBODIMENT

In the following section, a first preferred embodiment of the present invention will be described with reference to FIGS. 1 through 9.

Figure 1:
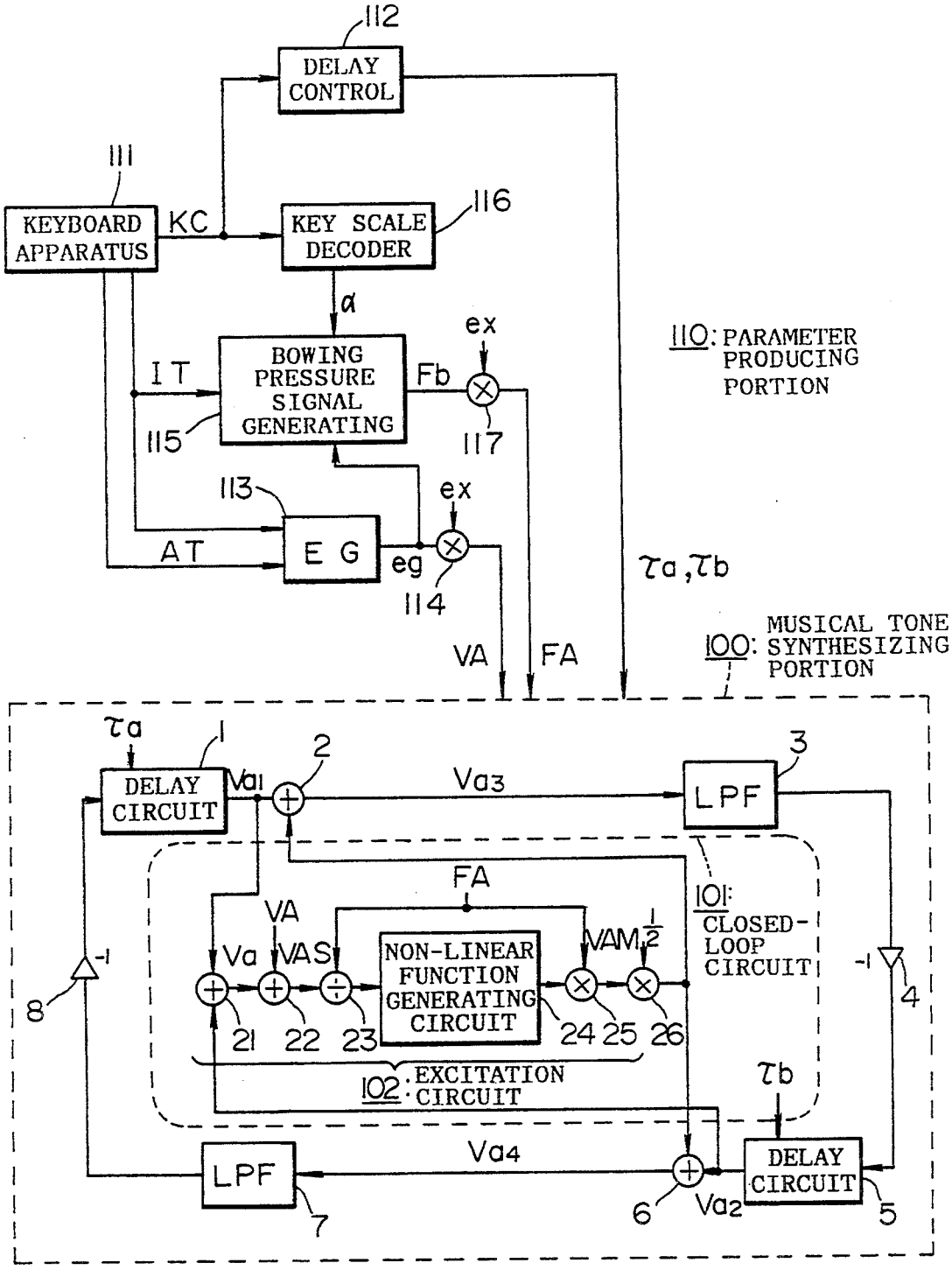
FIG. 1 is a block diagram showing the configuration of a musical tone synthesizing apparatus according to an first embodiment of the present invention.

In FIG. 1, a block diagram is shown illustrating the general layout of the musical tone synthesizing apparatus of the present embodiment. The apparatus shown in this drawing is suitable for simulating the sound of a stringed instrument such as a violin. In this simplified diagram, 100 designates a musical tone synthesizing portion which synthesizes a sound of a violin, 110 designates a parameter producing portion which produces control parameters used for controlling the operation of the musical tone synthesizing portion 100.

First, description will be given with respect to the musical tone synthesizing portion 100. The musical tone synthesizing portion 100 is made up of closed-loop circuit 101 and excitation circuit 102. Closed-loop circuit 101 simulates the vibration of an individual violin string, and hence corresponding to one string in the instrument being simulated. Excitation circuit 102 generates a excitation signal corresponding to the excitation vibration to be imparted to the string by the bow.

Figure 2:
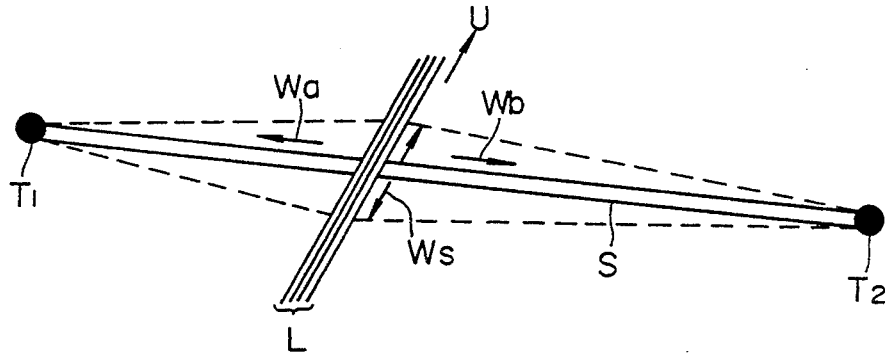
FIG. 2 is a introduction mechanism used for explaining the point at which the excitation vibration is introduced to bow of violin.

Next, description will be given with respect to a mechanism in the case when the excaltation vibration is introduced on string of violin in conjunction with FIG. 2, in advance of describing above-mentioned each component. In FIG. 2, S designates a string of violin, L designates a bow. Each end of string S is secured at a respective fixation point $T_1$or $T_2$ corresponding to a nut or a bridge of violin, respectively. When the violin is played by the performer in the state where the bow L is pressed against the string S as shown arrow U in FIG. 2, in the period when tile static fraction force is effected between the bow L and string S, the string S is moved in accordance with the movement of the bow L. Then, when the displacement of the string S becomes greater so that the elastic force of the string S exceeds the static friction force, the string S slips against the bow L so that It is returned in a direction directing to its original position. In this way, the string S is partially rubbed by the bow L and thereby receives the mechanical energy which has been imparted thereto by the bow L, this mechanical energy is manifested as the excitation vibration. In other words, the excitation vibration is exalted on the string S by use of the bow L. Actually, as the bow L is made of flux of many halts, in each rubbing string position wherein the string S is contacted with each hair, the above-mentioned excitation vibration Is excited.

The vibration excited on the string S in rubbing string position is distributed two directions and manifested as vibrational waves Wa, Wb. One vibration propagates on the string S toward fixation point $T_1$ as vibrational wave Wa, another vibration propagates on the string S toward fixation point $T_2$ as vibrational wave Wb. Vibrational wave Wa is inverted in phase and reflected at fixation point $T_1$, wherein vibrational wave Wa is changed the reflection wave. This reflection wave propagates again on the string S toward fixation point $T_2$. Vibrational wave Wb is inverted in phase and reflected at fixation point $T_2$, wherein vibrational wave Wb is changed the reflection wave. This reflection wave propagates again on the string S toward fixation point $T_1$. Both of vibrational waves Wa, Wb are added together on string S, and the string S vibrates in accordance with the standing-wave Ws of which nodes are occurred at the fixation point $T_1$ and $T_2$ of the string S.

Closed-loop circuit 101 shown in FIG. 1 simulates such as the above-mentioned propagation mechanism of vibration In the string S, and made up of delay circuit 1, adder 2, low pass filter 3, phase inverted 4, delay circuit 5, adder 6, low-pass filter 7 and phase inverted 8. Delay circuit 1 and 5 are capable of adjusting the delay time thereof. This type of delay circuit can be implemented, for example, by shift registers and a selector which selects one of delay outputs of shift registers.

Herein, the delay interval $\tau_a$ of delay circuit 1 is set as the time require for vibrational wave Wa to travel with reciprocal propagation from the rubbing position to fixation point $T_1$ on the string S. Similarly, the delay interval $\tau_b$ b of delay circuit 2 is set as the time require for vibrational wave Wa to travel with reciprocal propagation from the rubbing position to fixation point $T_2$ on the string S.

Phase inverters 4 and 8 correspond to fixation point $T_1$ or $T_2$, respectively, for the string S being simulated, and function to simulate the phenomena of reverse phase reflection of vibrational waves Wa, Wb at fixation point $T_1$ and $T_2$. Low-pass filters 3 and 7 simulate the frequency characteristics of the decrease in vibration on the string S. In particular, through the operation of filter 3 and 7, the phenomena of selectively greater decay in amplitude of the higher frequency harmonics in an actual string S is reproduced with fidelity.

Again reference to FIG. 1, excitation circuit 102 generates the excitation signal corresponding to the excitation vibration to be imparted to the string by bow and is made up of adder 21 and 22, subtracter 23, non-linear function generating circuit 24 and multiplier 25 and 26. The output signal $V_{a1}$ of delay circuit 1 and that $V_{a2}$ of delay circuit 5, i.e., the excitation signals, are summed in adder 21, the result of which is outputted as velocity signal $V_a$ which corresponds to the vibration velocity at rubbed position in string S. Velocity signal $V_a$ and signal VA representing of moving velocity of bow L (hereinafter referred to bowing velocity signal VA) are summed in adder 22, the result of which is outputted as signal VAS (hereinafter referred to difference speed signal VAS) which corresponds to the virtual relative velocity between the bow L and the string S in the case where if the string S does not subject to the bow L at all. Foregoing bow velocity signal VA is described later.

The circuit consisting of the subtracter 23, non-linear function generating circuit 24 and multiplier 25 is designed to simulate the follow-up characteristics of the string S with respect to the movement of the bow L. To subtracter 23 and multiplier 25, the signal FA corresponding to the pressure in which the string S is pushed by the bow L in rubbing string position (hereinafter referred to bowing pressure signal FA) is supplied as subtraction coefficient and multiplication coefficient, respectively. Foregoing bowing pressure signal FA is described later.

Figure 3:
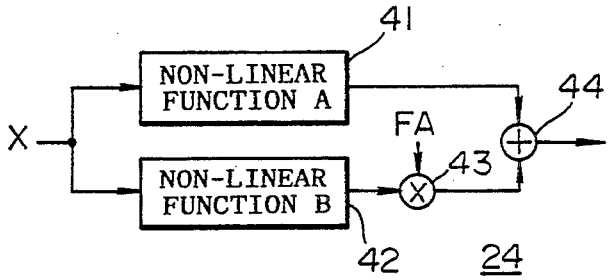
FIG. 3 is a block diagram showing detailed configuration of a non-linear function generating circuit shown in FIG. 1.
Figure 4:
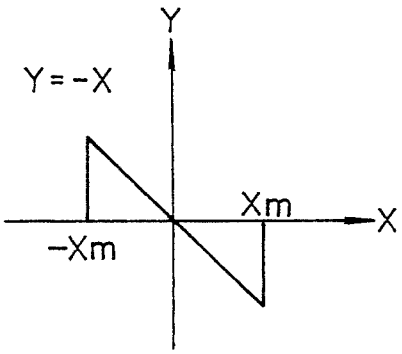
FIG. 4 to FIG. 7 are illustrations used for explaining the non-linear function used in the first embodiment.
Figure 5:
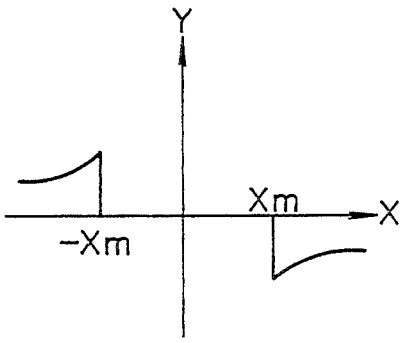
Figure 6:
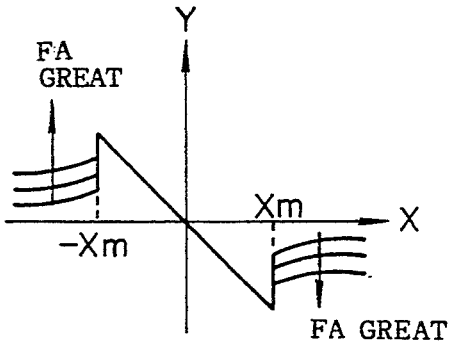

Non-linear function generating circuit 24 comprises ROM 41, 42, multiplier 43 and adder 44 as shown FIG. 3. The output signal of subtracter 23 shown in FIG. 1 is supplied to ROM 41 and 42 as input signal X. In ROM 41, the table of non-linear function A of which contents are shown in FIG. 4 is stored. As shown in FIG. 4, in the case where the input signal X is in range $-X_m$ to $X_m$, the output Y of ROM 41 Is equal to —X, in the case where the input signal X is out of range $-X_m$ to $X_m$, the output Y of ROM 41 is equal to zero. Similarly, in ROM 42, the table of non-linear function B of which contents are shown in FIG. 5 Is stored. As shown in FIG. 5, in the case where the input signal X is in range $-X_m$ to $X_m$, the output Y of ROM 42 is equal to zero, in the case where the input signal X is over $X_m$, the output Y of ROM 41 becomes to negative value, after which the output Y gradually approaches to zero due to the fact that the input X becomes greater toward the positive direction. On the other hand, when the input X is smaller than $-X_m$, the output Y becomes positive value, and the output Y gradually approaches to zero due to the fact that the input X becomes smaller toward the negative direction. The output of ROM 42 is multiplied in multiplier 43 by bowing pressure signal FA, and result of the multiplication is added to the output of ROM 41 In adder 44. Accordingly, the characteristics shown in FIG. 6 is obtained as the whole Input/output characteristics of non-linear function generating circuit 24. As shown in FIG. 6, in the case where the input signal X is in range $-X_m$ to $X_m$, non-linear function generating circuit 24 outputs the output signal Y which is equal to —X in accordance with nonlinear function A, in the case where the input signal X is In range $-X_m$ to $X_m$, that is, in the case where the input signal X is smaller than $-X_m$ and larger than $X_m$, non-linear function generating circuit 24 outputs the output signal Y in which non-linear function B is extended toward the direction of axis Y in response to the value of bowing pressure signal FA.

Figure 7:
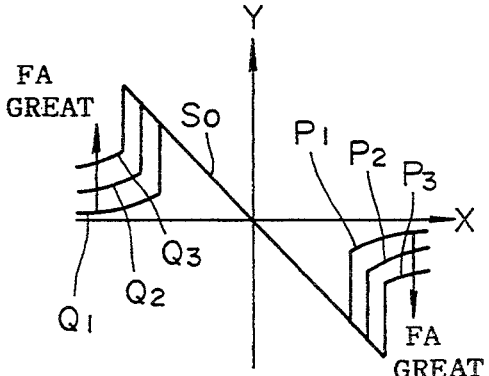

Since subtracter 23 is provided in front stage of non-linear function generating circuit 24 and multiplier 25 is provided in rear stage of non-linear function generating circuit 24, as shown in FIG. 7, the input/output characteristics In which the input/output characteristics shown in FIG. 6 Is extended toward the direction of axis X and axis Y in response to the value of bowing pressure signal FA is obtained as the whole input/output characteristics which corresponds the whole circuit being made up of subtracter 23, non-linear function generating circuit 24 and multiplier 25.

In multiplier 25, in the case where the absolute value of difference speed signal VAS is relatively smaller, the output signal of whole circuit described above is determined in accordance with the linear area $S_O$ in the input/output characteristics shown in FIG. 7, after which the excitation signal VAM corresponding to the above-mentioned output signal and is equal to -VAS is outputted from multiplier 25. The excitation signal VAM is multiplied in multiplier 26 by $\frac{1}{4}$, the result of multiplication ($=(\frac{1}{4})$*VAM) is inputted adder 2 and 6. Accordingly, the output signal $V_{a3}$ of adder 2 is represented the following formulae (1), similarly the output signal $V_{a4}$ of adder 6 is represented the following formulae (2).

$$\begin{aligned} V_{a3} &= V_{a1} + (\tfrac{1}{2})^{*}VAM \\ &= V_{a1} - (\tfrac{1}{2})^{*}VAS \\ &= V_{a1} - (\tfrac{1}{2})^{*}(VA + VS) \end{aligned} \tag{1}$$

$$\begin{aligned} V_{a4} &= V_{a2} + (\tfrac{1}{2})^{*}VAM \\ &= V_{a2} - (\tfrac{1}{2})^{*}VAS \\ &= V_{a2} - (\tfrac{1}{2})^{*}(VA + VS) \end{aligned} \tag{2}$$

In the above-mentioned formula (1) and (2), Vs is equal to $V_{a1} + V_{a2}$, and corresponds to velocity of the string S in the case where the effect of rubbing string is not considered. The signal $V_{a3}$ and $V_{a4}$ thus obtained described above are inputted to low-pass filter 3 and 7 as the signal representing of vibrational wave $W_a$ and $W_b$ in which the effect of rubbing string is considered, respectively. Herein, the sum of signal $V_{a3}$ and $V_{a4}$ corresponds to the velocity VSL of the string S in the case where the effect of rubbing string is considered, in this case, the velocity VSL is represented the following formulae (3).

$$\begin{aligned} VSL &= V_{a3} + V_{a4} \\ &= V_{a1} + V_a - (VA + VS) \\ &= -VA \end{aligned} \tag{3}$$

In other words, the string S moves with the velocity which is equal to the velocity of bow L. In this embodiment, the direction of bow L shown by arrow U in FIG. 2 is defined as positive moving direction , and the positive moving direction of the string S is inverted against the positive moving direction of the bow L. In this way, the static friction force is operated between the bow L and the string S, and the operation in which the string S is actually subjected to displace in response to the bow L can be simulated.

On the other hand, absolute value of the difference velocity signal VAS is relatively greater, operational point of excitation circuit 102 is varied from linear area $S_O$ in FIG. 7 to curved area $P_1, P_2, P_3, \ldots$ or $Q_1, Q_2, Q_3, \ldots$, the values of these curved area are outputted as the excitation signal VAM described above. Curved area $P_1, P_2, P_3, \ldots$ and $Q_1, Q_2, Q_3 \ldots$ correspond to the condition in which the string S is displaced against the bow L with slipping.

Herein, the point in which the output Y is varied from linear area $S_O$ to curved area is away from the origin of the coordinate axis as shown in FIG. 7 for greater the bowing pressure signal FA. In such way, the phenomenon in which as pressure force of the bow L is greater, the follow-up characteristics of the string S against the bow L is more good is simulated. In addition, as the bowing pressure signal FA becomes greater, the curved area to which operational point of excitation circuit 102 shifts is changed as $P_1$ (Q1)→$P_2$ (Q2)→$P_3$(Q3)→. . . Accordingly, if in the case where the string S is slipped against the bow L, the phenomenon in which as pressure force of the bow L is greater, the subjection characteristics of the string S against the bow L is more good is simulated.

The output signal VAM of multiplier 26 is divided into two part by multiplier 26, and supplied to adder 2 and 6 respectively. In this case, since the value of curved area is used as the excitation signal VAM, the signal $V_{a3}$ and $V_{a4}$ are slightly varied from the signal $V_{a1}$ and $V_{a2}$. In this way, the operation in which dynamic friction is operated between the bow L and the string S is simulated.

Next, description will be given with respect to the above-mentioned parameter producing portion 110. In FIG. 2, 111 designates a keyboard apparatus, which comprises a keyboard used as performance operator. In addition, keyboard apparatus 111 comprises a key-code generating portion for generating a key-code KC in response to the depressed key and a touch detecting portion for detecting a touch strength to thereby generate initial touch information IT and after touch information AT, respectively corresponding to each key. Initial touch Information IT is generated in response to touch strength such that in the case where touch strength is minimum value determined by this apparatus, IT Is equal to zero, in the case where touch strength is maximum value determined by this apparatus, IT is equal to "1".

112 designates a delay control ROM, which stores delay coefficient corresponding to the key-code KC. Delay coefficient read out from delay control ROM is supplied to musical tone synthesizing portion 100 where the delay time $\tau_a$ a of delay circuit 1 and the delay time $\tau_b$ of delay circuit 5 are set. In this case, the delay time $\tau_a$ and $\tau_b$ are set such that the time required for signal to circulate around closed-loop circuit 101 is equal to reverse number of primary resonance frequency of musical tone corresponding to the key-code KC.

113 designates a envelope generator, to which initial touch information IT and after touch information AT generated by keyboard apparatus 111 are supplied. Envelope generator 113 outputs the envelope waveform eg which rises up with velocity corresponding to the initial touch information IT and then falls down with velocity corresponding to the after touch information AT. This envelope waveform eg is multiplied in multiplier 114 by a multiplication coefficient ex, and the result of the multiplication is then supplied to musical tone synthesizing portion 100 as bowing velocity signal VA described above. The multiplication coefficient ex is set based on the operation of the operator assemblies such as the pedal, volume control etc., which are secured to the apparatus body.

115 designates a bowing pressure signal generating circuit, to which initial touch information IT and envelope waveform eg are inputted, and parameter $\alpha$ corresponding to the key code KC is also inputted from key scale decoder 116. This parameter $\alpha$ is used for controlling the peak value of the output signal of bowing pressure signal generating circuit 115. The output signal of bow pressure signal generating circuit 115 is multiplied in multiplier 117 by a multiplication coefficient ex, and the result of the multiplication is then supplied to musical tone synthesizing portion 100 as bowing pressure signal FA described above.

Figure 8:
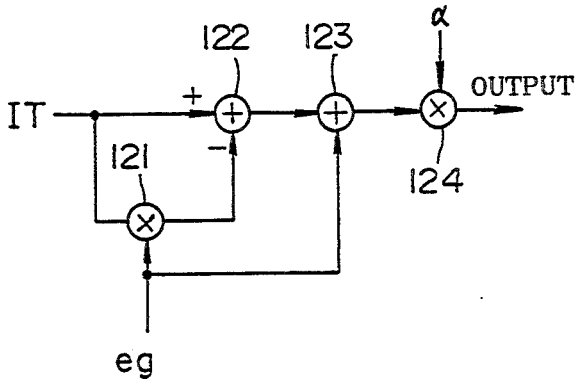
FIG. 8 is a block diagram showing the configuration of a bowing pressure signal generating circuit used in the first embodiment.

Next, description will be given with respect to the detailed configuration of the bowling pressure signal generating circuit 115 by referring to FIG. 8. In FIG. 8, bowling pressure signal generating circuit 115 comprises multiplier 121, 124, subtracter 122 and adder 123. Multiplier 121 multiplies initial touch information IT and amplitude value of envelope waveform eg together, subtracter 122 subtracts the result of multiplication of multiplier 121 from initial touch information IT. Adder 123 adds amplitude of the value of envelope waveform eg and the output of subtracter 122, multiplier 124 multiplies the output of adder 123 by multiplication coefficient a. Thus, by forming as described above the configuration of the bowing pressure signal generating circuit 115, the output signal $F_b$ shown in the following formula (4) is outputted from bowing pressure signal generating circuit 115.

$$F_b=\tau((1-IT)*eg+IT)\ldots \quad (4)$$

Figure 9A:
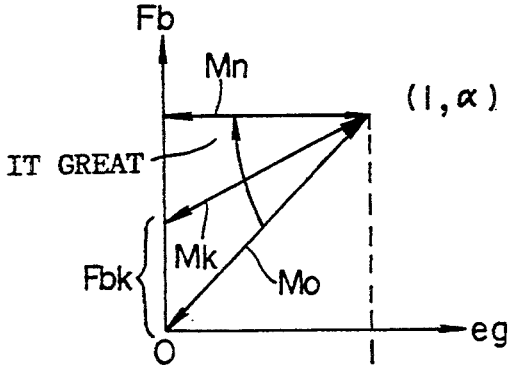
FIGS. 9(a) and 9(b) are illustrations used for explaining the input and output characteristic of the bowing pressure signal generating circuit used In the first embodiment.
Figure 9B:
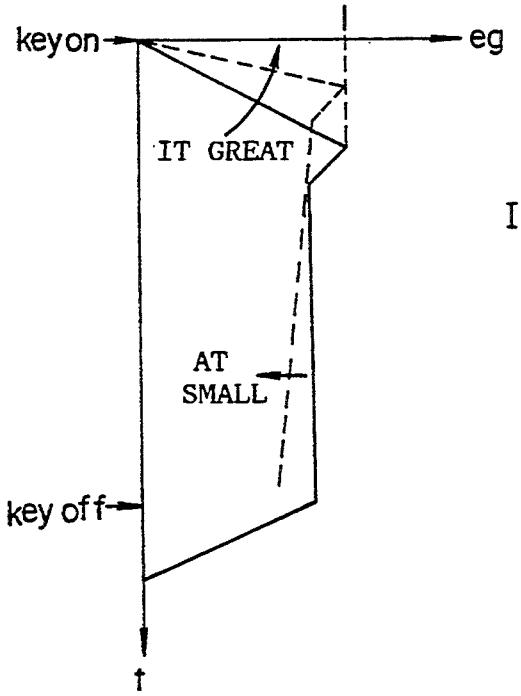

FIG. 9 (a) shows the input/output characteristics of bowing pressure signal generating circuit 115 which Is given by the foregoing formula (4). In addition, FIG. 9 (b) shows the variation of time lapse with respect to the lateral axis In FIG. 9 (a), that is , shows an example of envelope waveform eg.

[B]OPERATION OF FIRST EMBODIMENT

In the following section, the operation of the above described first embodiment of the present invention will be explained.

When any key in keyboard apparatus 111 is depressed, key-code KC corresponding to depressed key, initial touch information IT and after touch information AT are outputted. Then, the delay coefficient corresponding to the key-code KC is read out from delay control ROM 112, on which basis delay time $\tau_a$ of delay circuit 1 and delay time $\tau_b$ of delay circuit 5 in musical tone producing portion 100 are set. In addition, parameter a corresponding to the key-code KC is supplied to bowing pressure signal generating circuit 115 from key scale decoder 116, after which envelope waveform eg Is generated in accordance with initial touch information IT and after touch information AT in envelope generator 113. In multiplier 114, envelope waveform eg is multiplied by multiplication coefficient ex, and the result of the multiplication is then outputted as the bowing velocity signal VA. Furthermore, in bowing pressure signal generating circuit 115, the output signal $F_b$ is generated in accordance with initial touch information IT and parameter $\alpha$, as described following description.

First, the case where initial touch Information IT is equal to zero will be explained.

In this case, the output signal $F_b$ corresponding to each value of envelope waveform eg is outputted in accordance with linear line $M_0$ In FIG. 9 (a). Thus, as the amplitude value of envelope waveform eg rises up to "1" from "0" in FIG. 9 (b), the value of the signal $F_b$ is straightly varied from "0" to $\alpha$. Similarly, in the period where envelope waveform eg is reduced in accordance with after touch information AT, the output signal $F_b$ is outputted in accordance with linear lie $M_O$. The bowing pressure signal FA is outputted from multiplier 117 which is in proportion to the signal $F_b$.

Next, the case where initial touch information IT is over "0", for example, IT is equal to k (where $O<k<l$) will be explained.

In this case, the output signal $F_b$ corresponding to each value of envelope waveform eg is outputted in accordance with 1near line $M_k$ in FIG. 9 (a). Thus, in the time when the amplitude value of envelope waveform eg rises up from "0" in FIG. 9 (b), the value of the signal $F_b$ is more than "0" and becomes to value $F_{bk}$, after which the value of the signal $F_b$is varied from $F_{bk}$ to $\alpha$ in accordance with which the amplitude value of envelope waveform eg is larger. Similarly, in the period where envelope waveform eg is reduced in accordance with after touch information AT, the value of the output signal $F_b$ is determined in accordance with linear line $M_O$.

In addition, the case where initial touch information IT is equal to "1" corresponding to the maximum value, the output signal $F_b$ is determined in accordance with linear line $M_n$, the level of signal $F_b$ rapidly rises up to value a at the beginning of the generation of envelope waveform eg, after which in the period when envelope waveform eg have raised to "1" then after falls down to "0", the level of signal $F_b$ maintains the value a. In this way, the case where initial touch to the keyboard is relatively weak, the bowling pressure signal FA is controlled so as to slowly rise up in accordance with rising of envelope waveform eg together the bowing velocity signal VA, after which rapidly rise up more than the bowling velocity signal VA in accordance with which initial touch Is more strong. Thus, the bowing velocity signal VA and the bowing pressure signal FA are supplied to excitation circuit 102 in musical tone synthesizing portion 100, where the excitation signal VAM is generated described foregoing. The exaltation signal VAM is divided into two part by multiplier 26, and inputted to closed-loop circuit 101 via adder 2 and 6. The signal, which is outputted from excitation circuit 102 and supplied to closed-loop circuit 101, is circulated around the closed-loop, and again inputted to exaltation circuit 102. This operation corresponds to the phenomenon in which the vibration to be imparted to the string S by the bow L propagates to both direction from rubbing position, after which again return to initial rubbing position by reflecting at each fixation end. Then after, similarly the operation in which the excitation signal VAm is computed in excitation circuit 102 and Inputted to closed-loop circuit 101 is repeated. Thus, the signal circulating around closed-loop circuit 101 is picked up and outputted as musical tone signal. The picked up position of musical tone signal is arbitrary position in closed-loop circuit 101.

As described above, since the bowling velocity signal VA and the bowing pressure signal FA are controlled in accordance with initial touch information IT, in the case where initial touch is relatively weak, the sound of violin in the case of playing the bow courteously is generated. In this case, The musical tone of violin is effected by the bowing velocity signal VA. In addition, in the case where initial touch is strong, the sound of violin in the case of playing the bow strongly is generated. In this case, The musical tone of violin is effected by the bowing pressure signal FA. In this way, it is possible to variously control the musical tone by easy operation in which to adjust the touch of key is performed. In addition, in the case where the present apparatus is compared with the actual violin, the relationship between the force variation and tone color is resemble each other. Accordingly, the performer can enjoy playing the present apparatus with the impression great similar to that of the violin to be actually performed.

While, in above-mentioned first embodiment, the peak value of the bowling pressure signal FA is controlled in response to key-code KC, it is possible to control the other parameters such as the bowing velocity signal VA, the multiplication coefficient ex etc.

[C]SECOND EMBODIMENT

Figure 10:
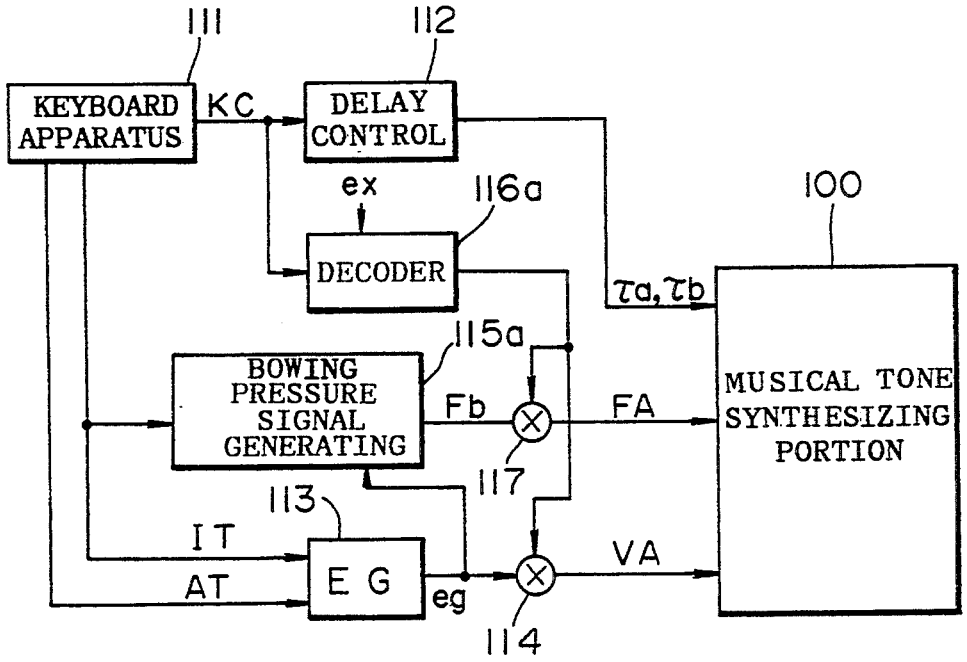
FIG. 10 is a block diagram showing the configuration of a musical tone synthesizing apparatus according to a second embodiment of the present invention.

Next, description will be given with respect to the second embodiment of the present invention by referring to FIG. 10. In FIG. 10, a block diagram is shown Illustrating the general layout of the musical tone synthesizing apparatus of the second embodiment. In FIG. 10, parts identical to those shown in FIG. 1 will be designated by the same numerals, hence, description thereof will be omitted. In the musical tone synthesizing apparatus according to the first embodiment described above, the bowling pressure signal FA is linearly varied to follow the variation of the amplitude value of envelope waveform eg. Notably, the second embodiment is characterized by varying the bowing pressure signal FA along with a predetermined curved line to follow the variation of the amplitude value of envelope waveform eg.

In FIG. 10, envelope waveform eg and initial touch information IT are inputted to bowing pressure signal generating circuit 115*a*, where the signal $F_b$ is computed in accordance with the following formulae (5) to (7).

$$F_b = eg^{(1/IT)} \text{ (where, } IT>)) \ldots \quad (5)$$

$$F_b = eg \text{ (where, } IT=0) \ldots \quad (6)$$

$$F_b = eg^{-IT} \text{ (where, } IT<0) \ldots \quad (7)$$

Figure 11:
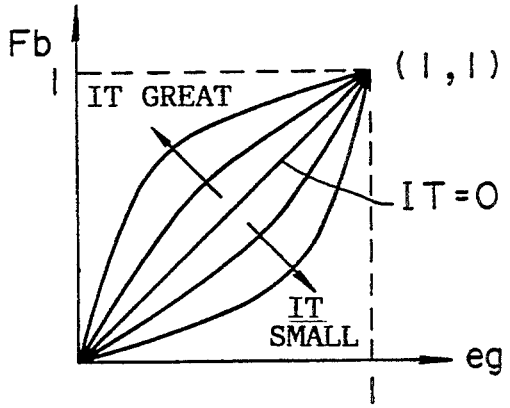
FIG. 11 is an illustration used for explaining the input and output characteristic of the bowling pressure signal generating circuit used in the second embodiment; introduction

In this embodiment it is designed that the initial touch information IT is set so as to be varied to positive value (corresponding to the case where initial touch Is strong) from negative value (corresponding to the case where initial touch is week). The signal $F_b$ described above is inputted to multiplier 117 where the bowing pressure signal FA is produced based on the signal $F_b$, after which the signal FA is supplied to musical tone synthesizing portion 100. FIG. 11 shows an example of Input-/output characteristics of bowing pressure signal generating circuit 115*a* which is represented foregoing formulae (5) to (7), that is, an example of the relationship between envelope waveform eg and the output signal $F_b$. In addition, in this embodiment, it is designed that multiplication coefficient which corresponds key-code KC and coefficient ex set by operator assembly mentioned-above is computed by means of decoder 116a, after which this multiplication coefficient is supplied to multiplier 114 and 117 where the signal FA and VA are adjusted the level thereof.

Accordingly, the bowing speed signal VA and the bowing pressure signal FA can be automatically produced so as to response to the strength of touch in the case of depressing the key, and the sounds of violin are synthesized. Furthermore, it is possible to vary the musical tones of violin in response to key touch.

[C]THIRD EMBODIMENT

Figure 12:
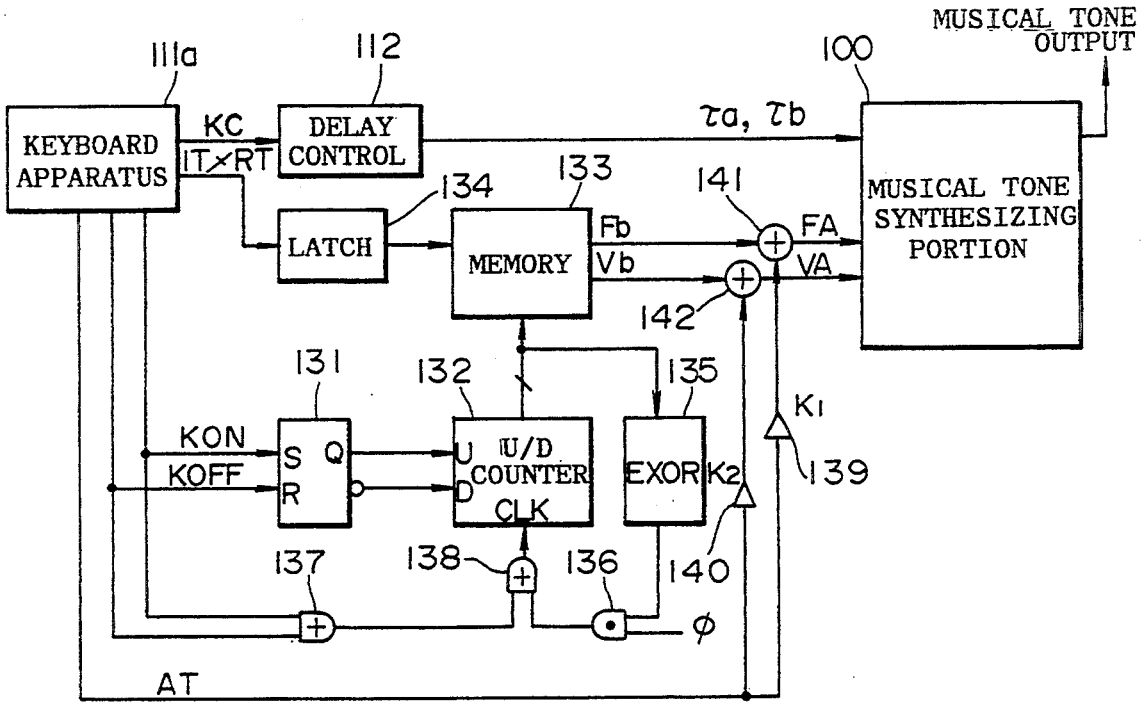
FIG. 12 is a block diagram showing the configuration of a musical tone according to a third embodiment of the present invention.

Next, description will be given with respect to the third embodiment of the present invention by referring to FIGS. 12 to 15. In FIG. 12, a block diagram is shown illustrating the general layout of the musical tone synthesizing apparatus of the third embodiment. In FIG. 12, parts identical to those shown in FIG. 1 will be designated by the same numerals, hence, description thereof will be omitted.

In FIG. 12, 131 designates a flip-flop, which is set by key-on signal KON outputted from keyboard apparatus 111a and reset by key-off signal KOFF outputted from keyboard apparatus 111a. 132 designates a up-down counter, which is set to up count mode in the case where the output Q of flipflop 131 is "1", on the other hands, set to down count mode in the case where the output Q of flip-flop 131 is "0". This up-down counter 132 is designed as the 12-bit counter, which count range is set between the hexadecimal values "OOOH" and "FFFH".

Figure 13:
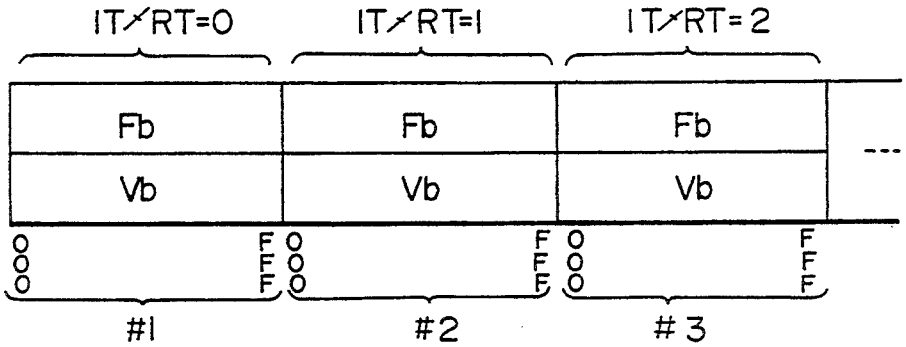
FIG. 13 shows stored content of memory used in the third embodiment.

In addition, 133 designates a memory, in which each memory area Is divided into a plurality of banks #1, #2, #3, . . . , and access for each memory area Is managed as shown in FIG. 13. in memory 133, memory address of each bank to which the internal bank address is given as "OOOh" to "FFFh". In each bank, a series of the value of signal $F_b$ and $V_b$ which corresponds to the initial touch strength of key being different from each other are stored, and the bowing pressure signal FA and the bowling velocity signal VA are produced used for these value of signal $F_b$ and $V_b$. The count output of up-down counter 132 Is supplied to memory 133 as internal bank address, and information IT/RT which represents initial-touch strength generated by keyboard apparatus 111a is also supplied to memory 133 through latch circuit 134 as bank designating address. By designating the address as described above, the signal $F_b$ and $V_b$ are read out from memory 133.

On the other hands, the count output of up-down counter 132 is inputted to exclusive OR gate 135, of which output signal is supplied to one input terminal of AND gate 136. To the other input terminal of AND gate 136, a sampling clock pulse $\phi$ is supplied at fixed intervals. In addition, the key-on signal KON and key-off signal KOFF are supplied to OR gate 137, then output signal of which and the output signal of AND gate 136 are supplied to OR gate 138, of which output signal is supplied to clock terminal CLK of up-down counter 132.

After-touch information AT generated from keyboard apparatus 111a is multiplied in multiplier 139 by coefficient $k_1$, and similarly multiplied in multiplier 140 by coefficient $k_2$. These coefficient $k_1$ and $k_2$ are set by means of operator assembly described above. In adder 141, the signal $F_b$ and the output signal of multiplier 139 are added together, the result of which is supplied to musical tone synthesizing portion 100 as the bowing pressure signal FA. In addition, the signal $V_b$ and the output signal of multiplier 140 are added together in adder 142, the result of which is supplied to musical tone synthesizing portion 100 as the bowing velocity signal VA.

Next, the operation of the third embodiment of the present invention will be explained in the following section.

In initial condition where prior to operation of keyboard apparatus 111a, the count output of up-down counter 132 is equal to "OOOh". Thus, for this reason, as the output of exclusive OR gate 135 is "0", the output of AND gate becomes to "0".

When any key in keyboard apparatus 111a is depressed, key-code KC corresponding to the depressed key, the information IT/RT in response to initial touch of key and after touch information are outputted from keyboard apparatus 111a. The key code KC is inputted to delay control ROM 112 on an equality with the first and second embodiments described above, after which the delay control In musical tone synthesizing portion 100 is performed based on the output of delay control ROM 112. In addition, the Information IT/RT is taken into latch circuit 134, after which the output of latch circuit 134 is supplied to memory 133 as bank designating address. On the other hands, flip-flop 131 is set by key-on signal KON, and the output of output terminal Q in flip-flop becomes to "1". Thus, up-down counter 132 is set to up-count mode. Contrary, the key-on signal KON is inputted to the clock terminal CLK of up-down counter 132 via OR gate 137 and 138. Thus, the count output of up-down counter 132 becomes to "OOO1h", and the output of exclusive gate 135 becomes to "1". After then the sampling clock ¢ is supplied to the clock terminal CLK of up-down counter 132 via AND gate 136 and OR gate 138, and 138. up-down operation is executed based on supplied the sampling clock ¢ in up-down counter 132. On the basis of the count output of up-down counter 132, the signal $F_b$ and signal $V_b$ corresponding to the count output of up-down counter 132 are sequentially read out from the bank designated by foregoing information IT/RT in memory 132. These signal $F_b$ and $V_b$ are multiplied by the outputs of multiplier 139 and 140 respectively, each result of multiplications is supplied to musical tone synthesizing portion 100 as the bowing pressure signal FA and the bowing velocity signal VA, respectively. When the count output of up-down counter 132 becomes to "FFFh", the output of exclusive gate 135 becomes to "0". Accordingly, supplying the sampling clock ¢ to up-down counter 132 is stopped, after which the bowling pressure signal FA and the bowing velocity signal VA are maintained to the constant value.

Next, when the key which has been depressed is release from depressing state, the key-off signal KOFF is generated by keyboard apparatus 111a and outputted to flip-flop 131, then which is reset. Furthermore, up-down counter 132 is changed over down-counter made in response to the output of flip-flop 131. In addition, the key-off signal KOFF Is supplied to the clock input terminal CLK of up-down counter 132 via OR gate 137 and 138. Accordingly, the count output of up-down counter 132 becomes to "FFEh", and in response to which the output of exclusive OR gate 135 becomes to "1". After then the sampling clock ¢ is supplied to the clock terminal CLK of up-down counter 132 via AND gate 136 and OR gate 138, and up-down operation is executed in accordance with supplied the sampling clock ¢. In up-down counter 132. In response to the count output of up-down counter 132, the signal $F_b$ and signal $V_b$, each having the value which is in reverse direction against the time in which the key-on signal KON is generated described above, are sequentially read out from the bank designated by foregoing information IT/RT in memory 133. These signal $F_b$ and $V_b$ are multiplied by the outputs of multiplier 139 and 140 respectively, each result of multiplications is supplied to musical tone synthesizing portion 100 as the bowing pressure signal FA and the bowling velocity signal VA respectively. When the count output of up-down counter 132 becomes to "OOOh", the output of exclusive gate 135 becomes to "0". Accordingly, supplying the sampling clock ¢ to up-down counter 132 is stopped. In this way, the producing control concerning the bowing pressure signal FA and the bowing velocity signal VA corresponding to the key operation is finished, and returned to the initial condition described above.

Figure 14A:
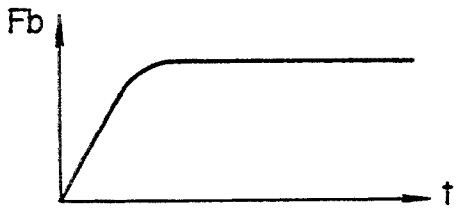
FIGS. 14(a) and 14(b) and FIGS. 15(a) and 15(b) are timing charts showing an operation of the third embodiment.
Figure 15A:
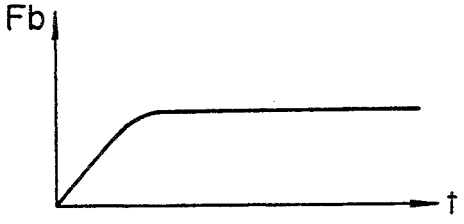
Figure 14B:
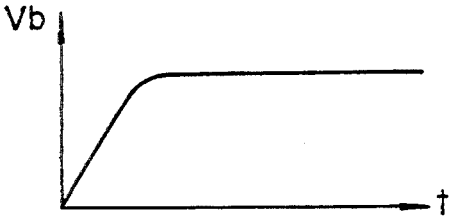
Figure 15B:
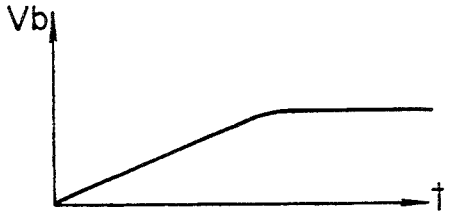
Figure 16:
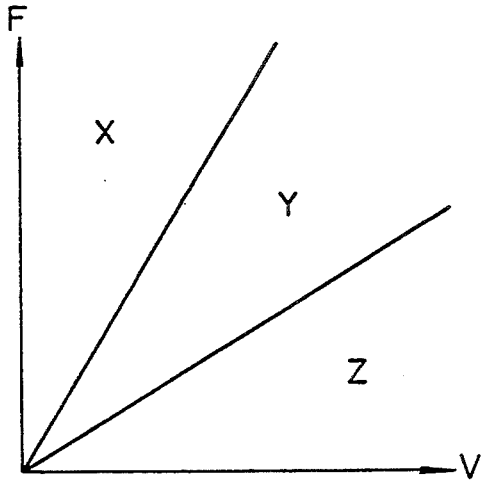
FIG.16 (PRIOR ART)
FIG. 16 is a operational map showing a range wherein musical tone can be generate according to conventional musical tone synthesizing apparatus to be applied for sound of a violin.

FIG. 14 (a) and FIG. 14 (b) show examples of variation of time lapse with respect to the signals $F_b$ and $V_b$respectively, which are read out from memory 133 in the case where initial touch representing of information IT/RT is relatively strong. Additionally, FIG. 15 (a) and FIG. 15 (b) show examples of variation of time lapse with respect to the signals $F_b$ and $V_b$ respectively, in the case where initial touch is relatively weak. As the result of controlling the generation of the signals $F_b$ and $V_b$, in the case where the initial touch representing of information IT/RT is relatively strong, the present apparatus can synthesize the musical tone to be generated when the bowing velocity rapidly rises up in response to the rising of the bowing pressure. On the other hands, in the case where the initial touch representing of information IT/RT is relatively weak, the present apparatus can synthesize the musical tone to be generated when the bowing velocity rises up slowly at the timing after the rising of the bowing pressure.

While in above-mentioned embodiment, the signals $F_b$ and $V_b$are stored into memory 133, it is possible to store the difference between adjacent two value of the signals which corresponds to adjacent two timings to be passed into the memory 133, so that each signals $F_b$ and $V_b$ is reproduced by accumulating the difference read out from memory 133. According to such processing, as number of required bit with respect to the difference can be very few, compared with number of required bit to store the signals $F_b$ and $V_b$, so that storage of memory 133 can be saved.

In addition, in above-mentioned embodiments, the constant value corresponding to the after touch information AT is added to the signals $F_b$ and $V_b$, it is possible to store the waveform corresponding to the after touch information AT into the memory 133, and to add the stored waveform by reading out to the signals $F_b$ and $V_b$.

Furthermore, the foregoing embodiments disclose the musical tone synthesizing apparatus which is applied to the plucked stringed musical instrument. However, it is possible to apply the present invention to the other acoustic musical instrument such as stroked stringed instrument, stringed instrument or tube instrument and the like.

In the present specification, preferred embodiments of the musical tone synthesizing apparatus of the present Invention has been described. The described embodiments meant to be illustrative, however, are not intended to represent limitations. Accordingly, numerous variations and enhancements thereto are possible without departing from the spirit or essential character of the present invention as described. The present Invention should therefore be understood to include any apparatus and variations thereof encompassed by the scope of the appended claims.

What is claimed is:

1. A musical tone synthesizing apparatus comprising:

(a) parameter producing means for automatically producing a plurality of control parameters over a period of time in response to operational information representing an operation applied to a musical instrument by a performer; and (b) musical tone synthesizing means for synthesizing a musical tone in accordance with said control parameters, wherein said synthesizing means includes closed-loop means having delay means for delaying a signal circulating in the closed loop means, and excitation means for receiving said control parameters and the signal circulating in the closed loop means and generating an excitation signal in response thereto for application to the closed-loop means for circulation therein, wherein a musical tone is synthesized by interaction of the excitation signal with a signal circulating in the closed-loop means.

2. A musical tone synthesizing apparatus according to claim 1 wherein said operation information represents a touch of a key, and said control parameters respectively represent bowing velocity and bowing pressure.

3. A musical tone synthesizing apparatus according to claim 1 wherein said musical tone synthesizing means simulates a tone generation mechanism of an acoustic musical instrument.

4. A musical tone synthesizing apparatus according to claim 1 wherein said control parameters are varied in a lapse of time.

5. A musical tone synthesizing apparatus according to claim 1 wherein said musical tone synthesizing apparatus simulates the sound of an acoustic musical instrument which is comprised of a tone generating element and a tone generating operator for exciting said tone generating element, thereby creating reciprocally propagating vibration within said tone generating element, said control parameters are used for controlling a simulation of said acoustic musical instrument, and said musical tone synthesizing means is for synthesizing a musical tone of said acoustic musical instrument.

6. A musical tone synthesizing apparatus according to claim 5 wherein said parameter producing means includes a keyboard apparatus having a keyboard, a key-code generating portion for generating a key-code corresponding to a depressed key and a touch detecting portion for detecting touch strength to thereby generate initial touch information and after touch information;

a delay control memory for storing a delay coefficient corresponding to the key-code, wherein said delay coefficient represents a delay time of the delay means provided in said musical tone synthesizing means;

an operator signal generating circuit for generating an operator signal representing a motion of said tone generating operator of said acoustic musical instrument, wherein said operator signal contains an operator velocity signal and an operator pressure signal; and an envelope generator for generating an envelope waveform which rises up with a velocity corresponding to the initial touch information and then falls down with a velocity corresponding to the after touch information, wherein said envelope waveform is multiplied by a predetermined multiplication coefficient, the result of the multiplication is then supplied to said musical tone synthesizing means as said operator velocity signal, said initial touch information, envelope waveform and a parameter corresponding to the key-code are inputted into said operator signal generating circuit, which output signal is multiplied by another multiplication coefficient, and then the result of the multiplication is supplied to said musical tone synthesizing means as said operator pressure signal.

7. A musical tone synthesizing apparatus according to claim 6 wherein a peak value of the output of said operator signal generating circuit is controlled in response to key-code,

8. A musical tone synthesizing apparatus according to claim 6 wherein said operator pressure signal is linearly varied in response to a variation of an amplitude of said envelope waveform.

9. A musical tone synthesizing apparatus according to claim 6 wherein said operator pressure signal is valued along with a predetermined curved line in response to a variation of an amplitude of said envelope waveform.

10. A musical tone synthesizing apparatus according to claim 6 wherein said parameter producing means provides with a memory means having a plurality of banks each storing a series of predetermined fundamental data corresponding to the initial touch strength of keyboard, said fundamental data being used for producing said operator speed signal and said operator pressure signal.

11. A musical tone synthesizing apparatus according to claim 6 wherein said parameter producing means provides with a memory means having a plurality of banks each storing a difference between adjacent two fundamental data which corresponds to adjacent two timings to be passed, said fundamental data corresponding to the initial touch strength of keyboard, so that each fundamental data is reproduced by accumulating the differences read from said memory means.

12. A musical tone synthesizing apparatus according to claim 6 wherein said after-touch information is incorporated in said fundamental data.

13. A musical tone synthesizing apparatus according to claim 5 wherein:

the delay means has a delay time corresponding to the reciprocity period of said reciprocally propagating vibration, wherein a period in which a signal traverses through said closed-loop circuit one time is set equal to the reciprocity period of said reciprocally propagating vibration; and said excitation signal is computed in accordance with said operational information and then supplied to said closed-loop circuit, wherein said excitation signal corresponds to the excitation of said tone generating element which is caused by said tone generating operator in said acoustic musical instrument.

14. A musical tone synthesizing apparatus according to claim 13 wherein said excitation means is provided with a memory means which stores a table of a non-linear function indicating a relative relationship between said tone generating operator and said tone generating element.

15. A musical tone synthesizing apparatus as in claim 1 wherein the parameter producing means produces said parameters which are suitable for generating tones for substantially all values of the operational information.

16. The musical tone synthesizing apparatus according to claim 1, wherein at least one of said control parameters corresponds to a pitch of the synthesized musical tone.

* * * * *